US010301072B1

(12) United States Patent
Dent et al.

(10) Patent No.: US 10,301,072 B1
(45) Date of Patent: May 28, 2019

(54) GARDEN HOSE SECURITY DEVICE

(71) Applicants: Robert L. Dent, Santa Monica, CA (US); Christopher R. Dent, Santa Monica, CA (US)

(72) Inventors: Robert L. Dent, Santa Monica, CA (US); Christopher R. Dent, Santa Monica, CA (US)

( * ) Notice: Subject to any disclaimer, the term of this patent is extended or adjusted under 35 U.S.C. 154(b) by 0 days.

(21) Appl. No.: 15/383,701

(22) Filed: Dec. 19, 2016

Related U.S. Application Data

(60) Provisional application No. 62/268,567, filed on Dec. 17, 2015.

(51) Int. Cl.

| | |
|---|---|
| ***B65D 6/18*** | (2006.01) |
| ***B65D 6/00*** | (2006.01) |
| ***B65D 25/24*** | (2006.01) |
| ***B65H 75/16*** | (2006.01) |
| ***B65D 85/04*** | (2006.01) |
| ***B65D 25/28*** | (2006.01) |
| ***E05B 67/38*** | (2006.01) |

(52) U.S. Cl.
CPC ..... *B65D 25/24* (2013.01); *B65D 7/26* (2013.01); *B65D 7/42* (2013.01); *B65D 11/1833* (2013.01); *B65D 11/20* (2013.01); *B65D 25/28* (2013.01); *B65D 85/04* (2013.01); *B65H 75/16* (2013.01); *E05B 67/383* (2013.01)

(58) Field of Classification Search
CPC . B65D 7/26; B65D 7/42; B65D 11/20; B65D 25/28; B65D 25/24; B65D 11/1833
USPC ..... 220/661, 4.21, 4.24, 4.25
See application file for complete search history.

(56) References Cited

U.S. PATENT DOCUMENTS

| | | | | |
|---|---|---|---|---|
| 3,310,905 A * | 3/1967 | Davis | A01K 97/06 | 206/315.11 |
| 3,514,005 A * | 5/1970 | Irwin | B65D 19/10 | 206/386 |
| 3,874,547 A * | 4/1975 | Howard | B65D 7/20 | 220/4.22 |
| 4,471,588 A * | 9/1984 | Schirm | E02D 5/801 | 52/154 |
| 4,925,045 A * | 5/1990 | Logsdon | E04G 15/061 | 220/3.94 |
| 5,472,088 A * | 12/1995 | Roberts | B65D 85/672 | 206/394 |
| 5,678,596 A | 10/1997 | Corallo | | |
| 6,050,291 A | 4/2000 | Whitehead et al. | | |
| 6,546,953 B1 | 4/2003 | Kowalke | | |

(Continued)

OTHER PUBLICATIONS

Fairfield Garden Hose Bin. Product Listing [online]. Mayne, 2013 [retrieved on Sep. 1, 2015]. Retrieved from the Internet:https://www.wayfair.com/Mayne-Inc.-Fairfield-Garden-Hose-Rin-MYN1099.html.

*Primary Examiner* — Jeffrey R Allen
(74) *Attorney, Agent, or Firm* — Cramer Patent & Design, PLLC; Aaron R. Cramer

(57) ABSTRACT

A garden hose security device is fashioned as a tripartite hinged cube. The base of the device has a piano hinge on opposing sides thereof. Each piano hinge is connected to an edge of a side cube which is open at one (1) face and one (1) side. Each open side faces the base. Each open face is positioned opposite the other side cube's open face. There is an aperture for a faucet on the back side of the device. Secured to the underside of the base is a spiral-shaped ground stake. Padlock hardware is capable of being secured to the cube side opposite the faucet aperture.

2 Claims, 8 Drawing Sheets

(56) References Cited

U.S. PATENT DOCUMENTS

| | | | | |
|---|---|---|---|---|
| 8,082,944 | B2 | 12/2011 | Rosine et al. | |
| D712,236 | S | 9/2014 | Blaszczak et al. | |
| 2011/0036025 | A1* | 2/2011 | Boulay | E02D 5/801 52/157 |
| 2011/0290827 | A1 | 12/2011 | Gilpatrick | |
| 2012/0192960 | A1 | 8/2012 | Chang | |

* cited by examiner

GARDEN HOSE SECURITY DEVICE

RELATED APPLICATIONS

The present invention is a continuation of, was first described in, and claims the benefit of U.S. Provisional Application No. 62/268,567 filed Dec. 17, 2015, the entire disclosures of which are incorporated herein by reference.

FIELD OF THE INVENTION

The present invention relates generally to the field of locking mechanisms and more specifically relates to a garden hose locking device that may be secured to the ground to prevent theft of garden hoses.

BACKGROUND OF THE INVENTION

Unfortunately, in today's society, items get stolen all the time. Surprisingly, a common problem is the theft of garden hoses and other water carrying pipes that are left unattended for certain periods of time. This has become a reoccurring problem at many golf courses, apartment complexes, public parks and not to mention residential homes. In an effort to minimize and prevent the theft of garden hoses and other water carrying pipes, golf courses, apartment complexes and public parks have taken steps to install underground sprinkler systems. However, for individual homeowners, an underground sprinkler or irrigation system is too expensive or too difficult to install to consider as an option. This is not desirable.

Various attempts have been made to solve problems found in locking mechanism art. Among these are found in: U.S. Pat. Nos. 4,803,858; 5,193,366; and 4,793,376. These prior art references are representative of locking mechanisms.

None of the above inventions and patents, taken either singly or in combination, is seen to describe the invention as claimed. Thus, a need exists for a reliable locking mechanism that may be secured to the ground and prevent theft of garden hoses, and to avoid the above-mentioned problems.

SUMMARY OF THE INVENTION

It is therefore an object of the present invention to provide a security box which comprises a first body half, a second body half and a center panel. The first body half has a first body half first side, a first body half front side, a first body half top side and a first body half rear side. The second body half has a second body half first side, a second body half front side, a second body half top side and a second body half rear side. The center panel is hingedly secured at a first end to a bottom edge of the first body half first side and hingedly secured at a second end, and opposite the center panel first end, to a bottom edge of the second body half first side. A first cut-out is located along an interior side edge of the first body half rear side, subjacent the first body half top side while a second cut-out located in mirror opposition to the first cut-out along an interior side edge of the second body half rear side, subjacent the second body half top side. An anchor comprising a corkscrew is secured to a central underside portion of the center panel. In an alternate embodiment, the anchor may comprise a rod which is secured at a proximal end to a central underside portion of the center panel and a plate secured to a distal end of the rod wherein the anchor is capable of securing the security box to a surface.

The first body half and second body half is capable of being configured to a closed state. The first cut-out and the second cut-out are co-aligned with each other when the security box is in the closed state. The first cut-out and the second cut-out are configured to permit a passage of a garden hose and a faucet the cut-outs when combined. A first fastener, is secured along a first interior edge of the first body half front side and a second fastener, is secured along a first interior edge of the second body half front side which is opposite the first fastener. The first and second fasteners are capable of mating with each other to secure the security box in a closed state.

The center panel may have a plurality of apertures. The first cut-out comprises a first gasket and the second cut-out comprises a second gasket. The first and second gaskets comprise opposing hemispherical cut-outs. The first and second gaskets may also comprise durable weather resistant rubber. The first body half and the second body half comprise plastic or metal. The anchor comprises plastic. The security box may also comprise a pair of handles.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
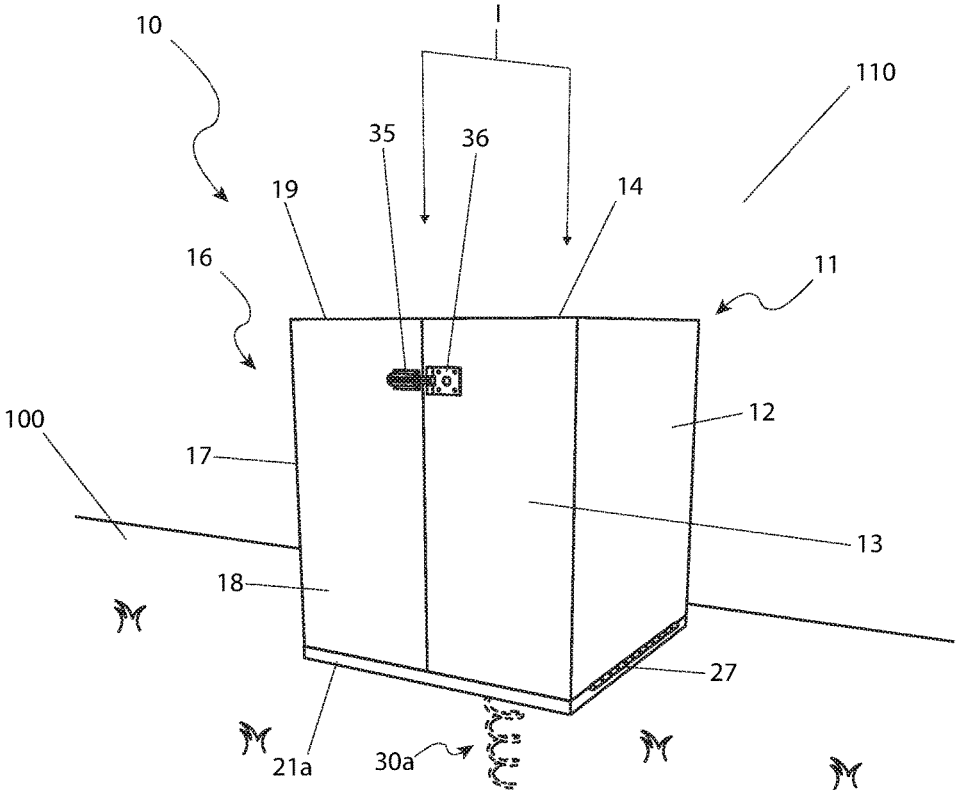
FIG. 1 is a perspective view of a garden hose security box 10, according to a first embodiment of the present invention.

10 garden hose security box
11 first body half

12 first body half first side
13 first body half front side
14 first body half top side
15 first body half rear side
16 second body half
17 second body half first side
18 second body half front side
19 second body half top side
20 second body half rear side
21*a* first center panel
21*b* second center panel
22 first anchor plate
23 first anchor plate weldment
25 first hinge
27 second hinge
30*a* first anchor
30*b* second anchor
31 second anchor first nut
32 second anchor first washer
33 second anchor plate
34 second anchor rod
35*a* first fastener
36*a* second fastener
37 second center panel first aperture
38 second anchor plate aperture
39 second anchor plate second washer
40 first cut-out
41 second anchor second nut
45 second cut-out
46 first gasket
47 second gasket
48 plurality of drainage apertures
49 first handle
50 second handle
100 surface
110 structure
120 faucet
130 hose

DETAILED DESCRIPTION OF THE PREFERRED EMBODIMENT

Figure 2:
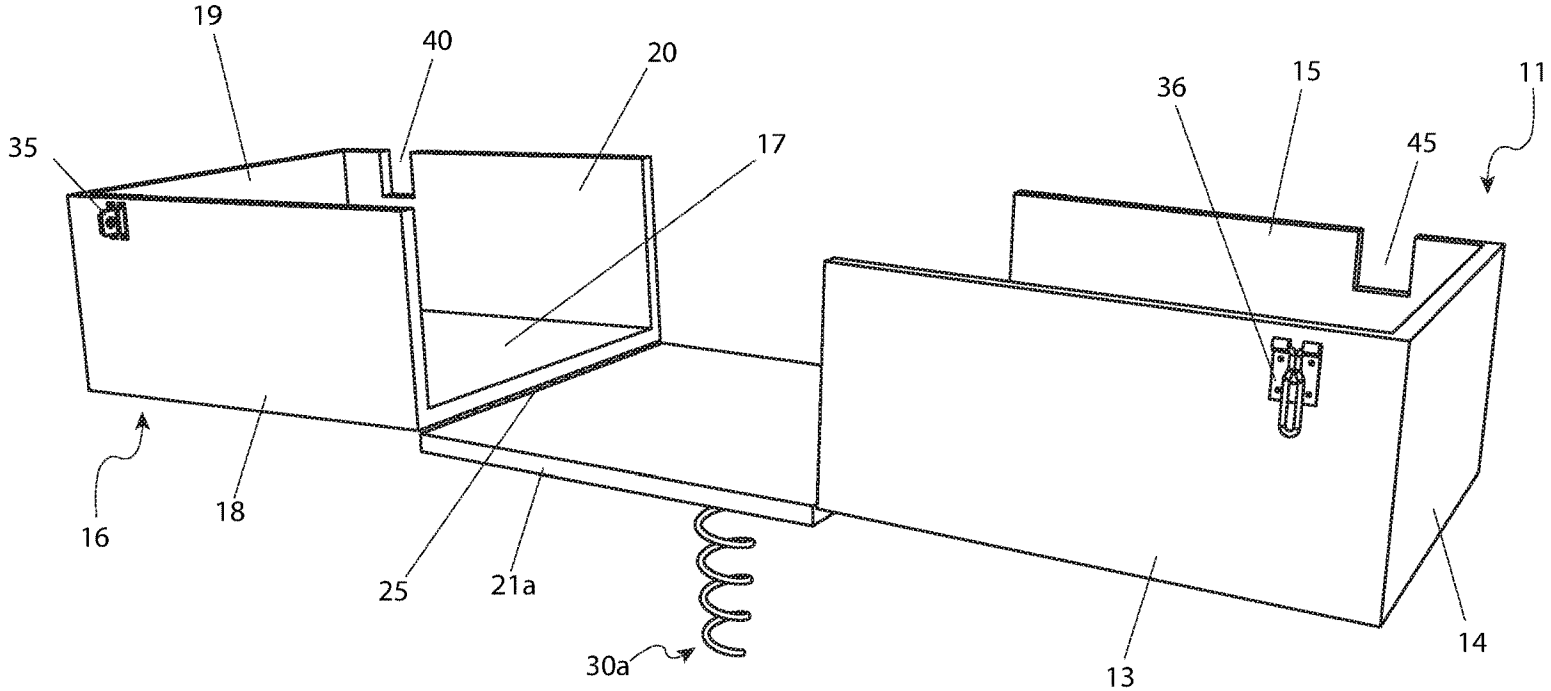
FIG. 2, is a perspective view illustrating the garden hose security box 10 in an open condition, according to a first embodiment of the present invention.
Figure 3:
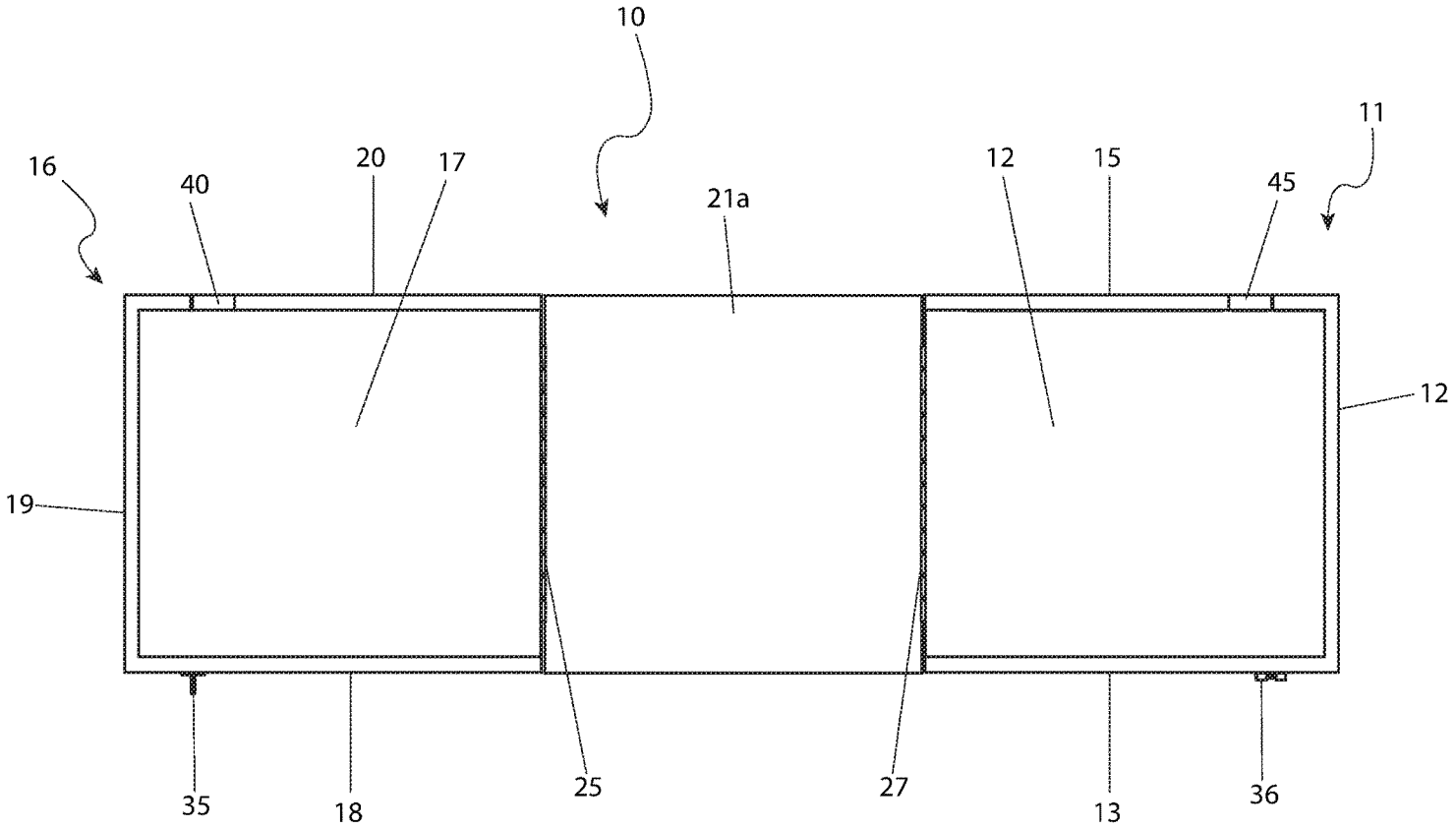
FIG. 3 is a top plan view illustrating the garden hose security box 10 in an open condition, according to a first embodiment of the present invention.
Figure 4:
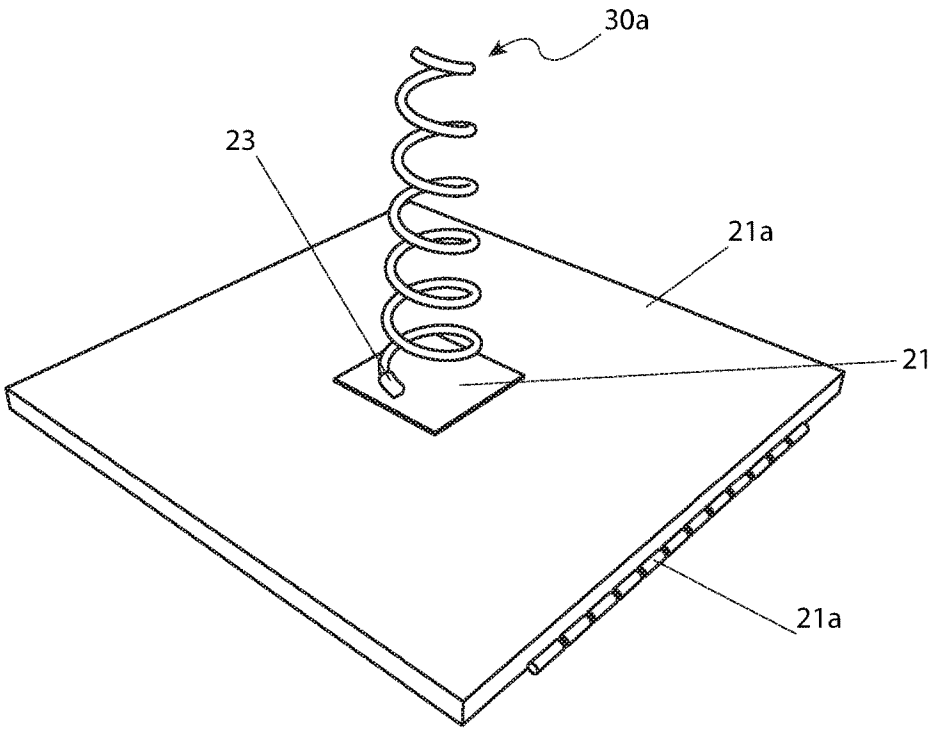
FIG. 4 is a perspective view illustrating the bottom side view of the first center panel 21*a*, projecting a first anchor 30*a*, according to a first embodiment of the present invention.
Figure 6:
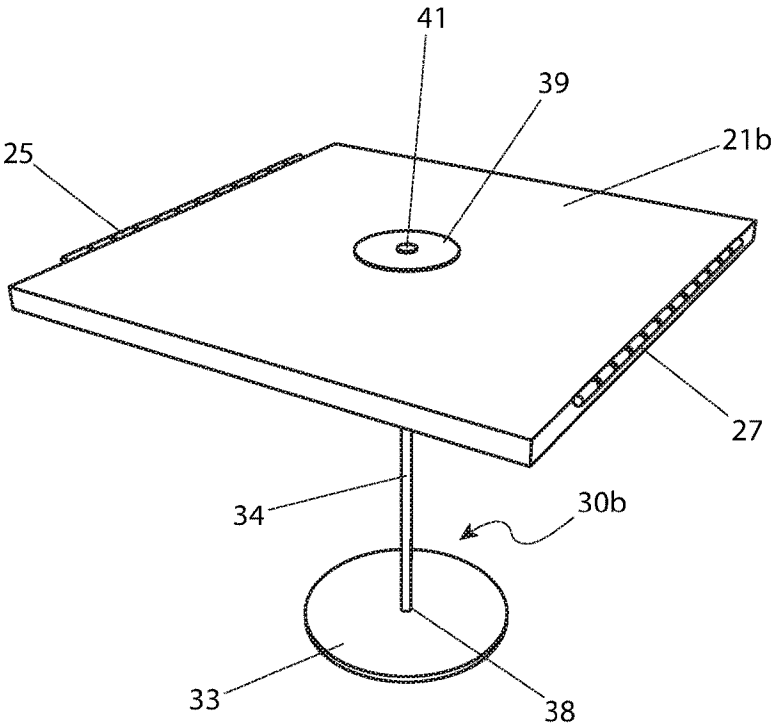
FIG. 6 is a perspective view illustrating the top side view of the second center panel 21*b*, projecting a second anchor 30*b*, according to a second embodiment of the present invention.
Figure 5:
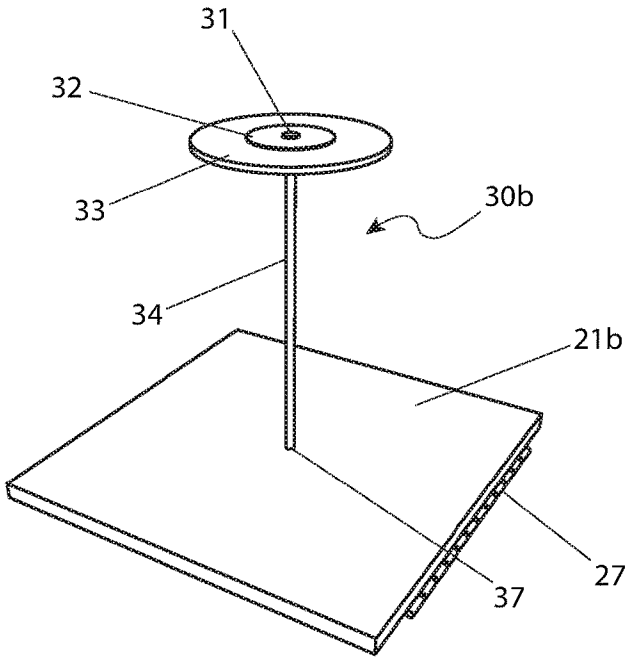
FIG. 5 is a perspective view illustrating the bottom side view of the second center panel 21*b*, projecting a second anchor 30*b*, according to a second embodiment of the present invention.
Figure 8:
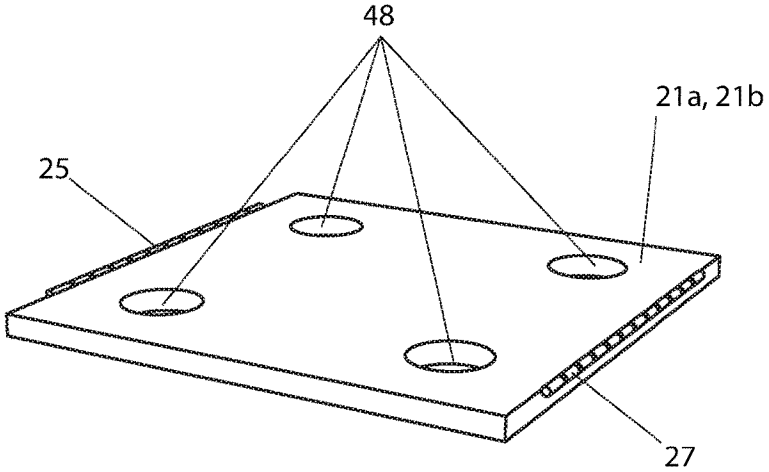
FIG. 8 is a perspective view illustrating the top side view of the first center panel 21*a* or second center panel 21*b*, having a plurality of plurality of drainage apertures 48 according to a fourth embodiment of the present invention.
Figure 7:
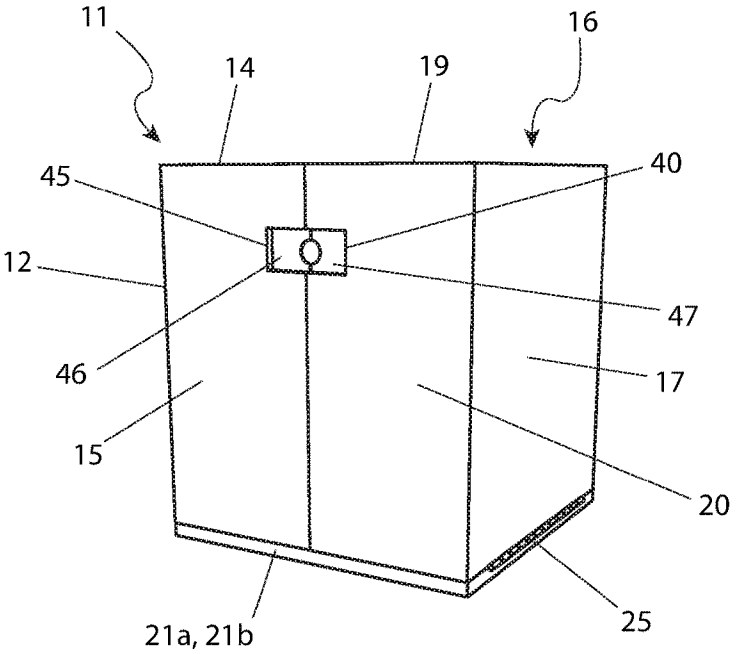
FIG. 7 is a perspective view of a garden hose security box 10, according to a third embodiment of the present invention, depicting a first gasket 46 a second gasket 47.
Figure 9:
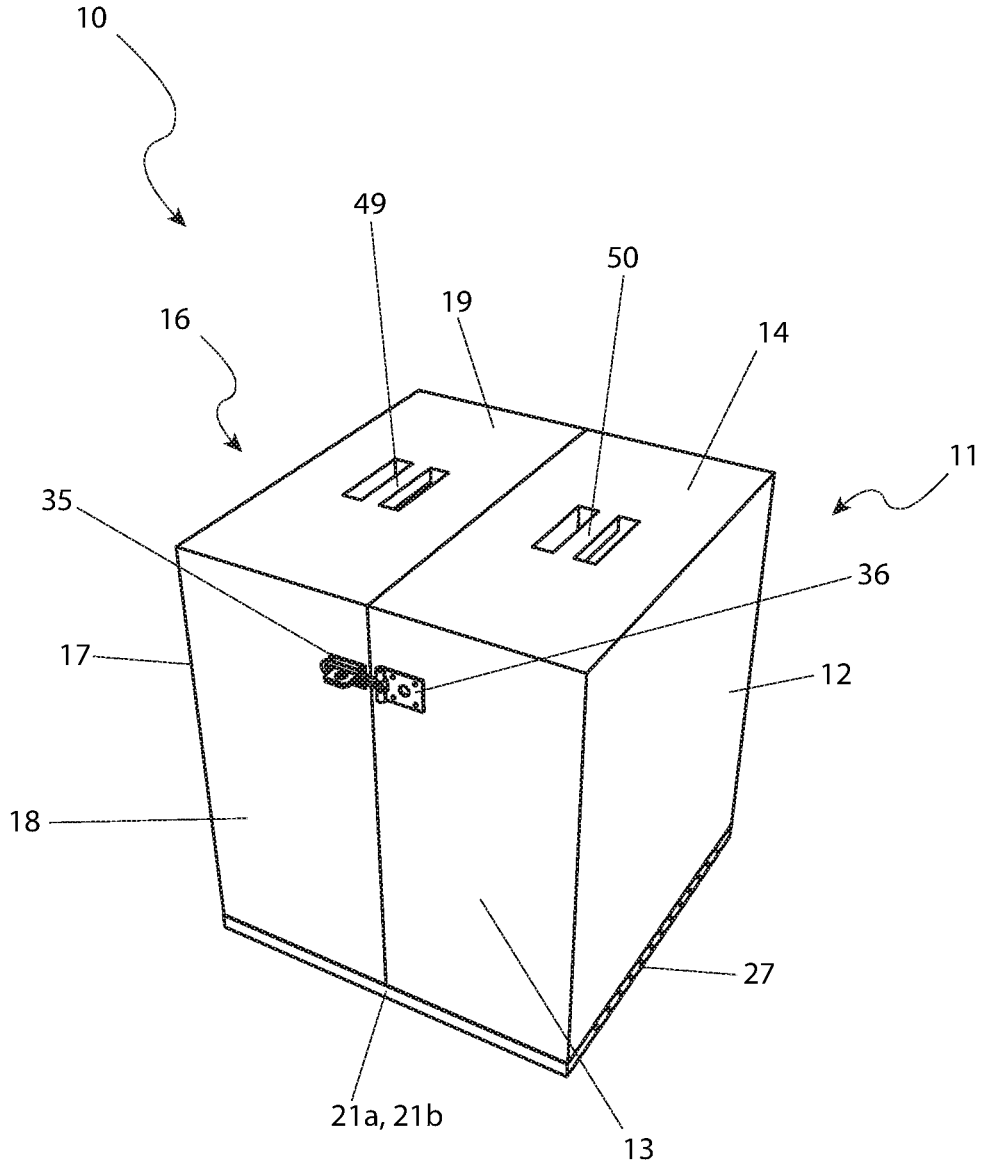
FIG. 9 is a perspective view of a garden hose security box 10, according to a fifth embodiment of the present invention, depicting a first handle 48 disposed within the second body half top side 19 and a second handle 49 disposed within the first body half top side 14; and, FIG. 10 is a sectional view of a garden hose security box 10 taken along line I as depicted in FIG. 1 showing a faucet 120 and attached hose 130 secured within security box 10 which in turn is secured within surface 100.

The present invention is directed to a garden hose security box 10. Referring now to the drawings, there is shown in FIG. 1 is a perspective view of a garden hose security box 10, according to a first embodiment of the present invention; FIG. 2 is a perspective view illustrating the garden hose security box 10 in an open condition, according to a first embodiment of the present invention; FIG. 3 is a top plan view illustrating the garden hose security box 10 in an open condition, according to a first embodiment of the present invention; FIG. 4 is a perspective view illustrating the bottom side view of the first center panel 21*a*, projecting a first anchor 30*a*, according to a first embodiment of the present invention; FIG. 5 is a perspective view illustrating the bottom side view of the second center panel 21*b*, projecting a second anchor 30*b*, according to a second embodiment of the present invention; FIG. 6 is a perspective view illustrating the top side view of the second center panel 21*b*, projecting a second anchor 30*b*, according to a second embodiment of the present invention; FIG. 7, is a perspective view of a garden hose security box 10, according to a third embodiment of the present invention, depicting a first gasket 46 a second gasket 47; FIG. 8, is a perspective view illustrating the top side view of the first center panel 21*a* or second center panel 21*b*, having a plurality of plurality of drainage apertures 48 according to a fourth embodiment of the present invention; FIG. 9, is a perspective view of a garden hose security box 10, according to a fifth embodiment of the present invention, depicting a first handle 48 disposed within the second body half top side 19 and a second handle 49 disposed within the first body half top side 14; and, FIG. 10, which depicts a sectional view of a garden hose security box 10 taken along line I as depicted in FIG. 1 showing a faucet 120 and attached hose 130 secured within security box 10 which in turn is secured within surface 100.

Referring now to FIGS. 1-4, the security box 10 has a first body half 11 and second body half 16. The first body half 11 comprises a first body half first side 12, a first body half front side 13, a first body half top side 14, and first body half rear side 15. The second body half 16 comprises a second body half first side 17, a second body half front side 18, a second body half top side 19, and second body half rear side 20.

A first hinge 25 connects the second body half 16 to a first side of the center panel 21*a* at the bottom edge of the second body half first side 17. A second hinge 27 connects the first body half 11 to a second and opposite side of the center panel 21*a* at the bottom edge of the first body half first side 12. In a closed configuration, the security box 10 defines an interior cubic rectangular shape void sufficiently sized such that a garden hose is able to be enclosably stored within during periods of non-use.

A cut-out 40 is located along an interior side edge of the second body half rear side 20, subjacent second body half top side 19 while a cut-out 45 is located in mirror opposition to cut-out 40, along an interior side edge of the first body half rear side 15, subjacent first body half top side 14. The pair of cut-outs 40, 45 combine to permit passage of an outdoor faucet installation therethrough and is secured to the ground by a first anchor 30*a*, such as a spike or stake (or other suitable securing means).

The first anchor 30*a* will provide dependable support for the security box 10 above the ground. The first anchor 30*a* may comprise a rigid plastic or metal material. The first anchor 30*a* may be a cork screw design and may be screwed or twisted in the ground or secured into concrete if desired. The first anchor 30*a* is affixed to a first anchor plate 22 by a weldment 23 or other means commonly accepted within the industry. The first anchor plate 22 is secured to a bottom central part of the first center panel 21*a* of the security box 10 by a weldment, industrial adhesive or other means commonly accepted within the industry.

As detailed above, the security box 10 preferably comprises a cubic rectangular shape, approximately thirty-six inches (36 in.) tall, twenty-four inches (24 in.) deep, and twenty-four inches (24 in.) wide. A first fastener 35*a* is located on the front face of the second body half front side 18 and a second fastener 36*a* is located on the front face of the first body half front side 13 opposite the first fastener 35*a*. When the security box 10 is closed, the first fastener 35*a* is capable of mating with the second fastener 36*a*, thereby locking the security box 10 in the closed state. The first fastener 35*a* and second fastener 36*a* may be configured to accept a removable combination or keyed lock (please see FIG. 9). The security box 10 may be manufactured using plastic and metal or either. The exact specifications, materials used, and method of use of the security box 10 may vary upon manufacturing. Other sizes of security boxes 10 may be available.

Referring now to FIGS. 5-6, in a second embodiment of security box 10, a second anchor 30*b*, secured to a second center panel 21*b*, is depicted and may also provide dependable support for the security box 10 above the ground when the second anchor 30*b* is secured to the second center panel

21*b*, while encased in earth, stone or concrete. The second anchor comprises a second anchor plate 33 which is secured at a distal end of a second anchor rod 34 by a second anchor first washer 32 and second anchor first nut 31 through a second anchor plate aperture 38. The proximal end of the second anchor rod 34 is secured to the central bottom side of the second center panel 21*b* by a second anchor plate second washer 39 and second anchor second nut 41 through a second center panel first aperture 37.

Referring now to FIG. 7, in a third embodiment of security box 10, a first gasket 46 secured within second cut-out 45 and a second gasket 47 secured within first cut-out 40 is depicted. Each gasket 46, 47 is friction fit or adhered to the interior respective portion of each cut-out 40, 45. Each gasket is made of a durable weather resistant material such as rubber and possesses a hemispherical cut-out, mirror opposite each other, such that in a closed configuration both gaskets 46, 47 form a secure seal about a portion of a garden hose which extends beyond the external perimeter of the security box 10.

Referring now to FIG. 8, in a fourth embodiment of security box 10, the first central panel 21*a* or the second central panel 22*b*, is depicted showing a plurality of drainage apertures 48. Each drainage aperture 48 is configured to permit excess water from a garden hose stored within or exterior leakage from rain to pass into the supporting environment beneath the first central panel 21*a* or the second central panel 22*b*.

Referring now to FIG. 9, in a fifth embodiment of security box 10, the security device 10 is depicted with a first handle 49 disposed within the second body half top side 19 and a second handle 50 disposed within the first body half top side 14. Each handle 49, 50 is either integrally molded to each respective top side 14, 19 or attached thereto by any suitable means known within the industry.

Figure 10:
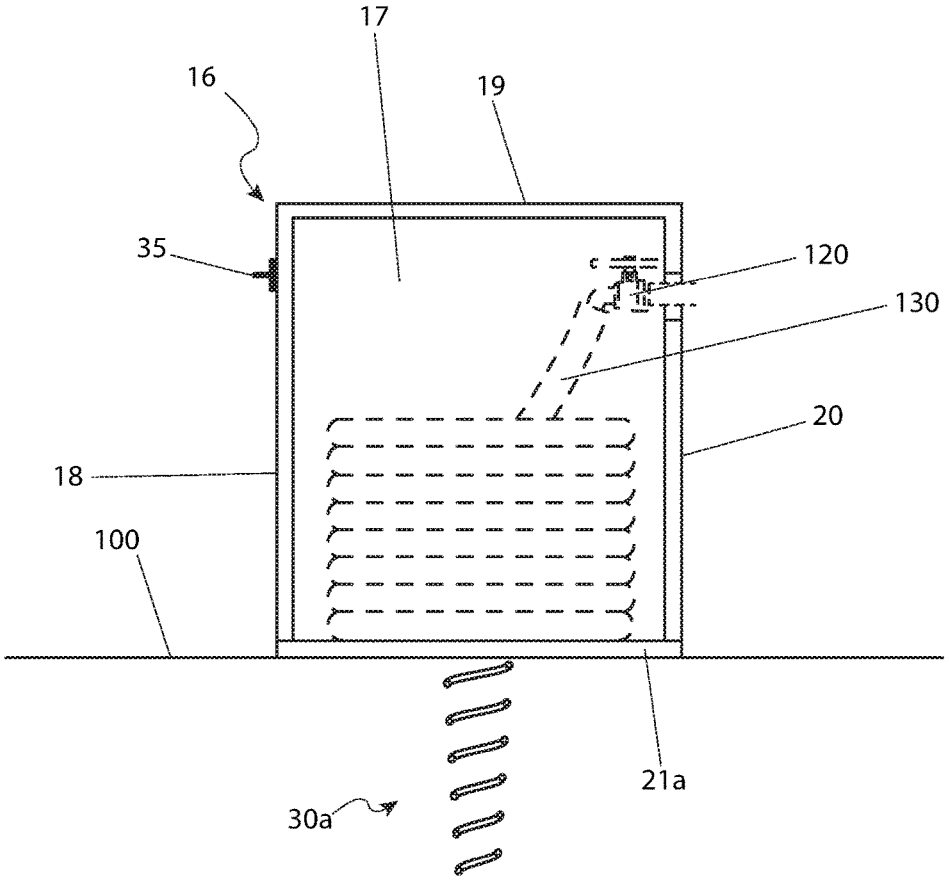

Referring lastly to FIG. 10, which depicts a sectional view of a garden hose security box 10 taken along line I as depicted in FIG. 1 showing a faucet 120 and attached hose 130 secured within security box 10 which in turn is secured within surface 100. The hose 130 may of course be stored in any manner within the security box 10 which permits the enclosure of the security box 10 about the hose 130.

The foregoing descriptions of specific embodiments of the present invention have been presented for purposes of illustration and description. They are not intended to be exhaustive or to limit the invention to the precise forms disclosed, and obviously, many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A security box, comprising:

a first body half having a first body half first side, a first body half front side, a first body half top side and a first body half rear side;

a second body half having a second body half first side, a second body half front side, a second body half top side and a second body half rear side;

a center panel hingedly secured at a first end to a bottom edge of said first body half first side and hingedly secured at a second end, and opposite said center panel first end, to a bottom edge of said second body half first side, wherein said center panel has a plurality of apertures;

a first cut-out located along an interior side edge of said first body half rear side, subjacent said first body half top side;

a second cut-out located in mirror opposition to said first cut-out along an interior side edge of said second body half rear side, subjacent said second body half top side;

a first handle disposed within said first body half top side;

a second handle disposed within said second body half top side;

an anchor having a corkscrew secured to a central underside portion of said center panel;

wherein said anchor securing said security box to a surface;

wherein said first body half and said second body half are both capable of being in a single closed state;

wherein said first cut-out and said second cut-out are co-aligned with each other when said security box is in said closed state;

wherein said first cut-out and said second cut-out permit a passage of a garden hose and a faucet therethrough;

wherein said first cut-out includes a first gasket and said second cut-out includes a second gasket;

wherein said first and second gaskets include opposing hemispherical cut-outs;

wherein said first and second gaskets include durable weather resistant rubber; and wherein a first fastener secured along a first interior edge of said first body half front side and a second fastener secured along a first interior edge of said second body half front side opposite said first fastener, are mating with each other to secure said security box in said closed state;

wherein said first body half and said second body half are plastic or metal; and wherein said anchor is metal or plastic.

2. A security box, comprising:

a first body half having a first body half first side, a first body half front side, a first body half top side and a first body half rear side;

a second body half having a second body half first side, a second body half front side, a second body half top side and a second body half rear side;

a center panel hingedly secured at a first end to a bottom edge of said first body half first side and hingedly secured at a second end, and opposite said center panel first end, to a bottom edge of said second body half first side, wherein said center panel has a plurality of apertures;

a first cut-out located along an interior side edge of said first body half rear side, subjacent said first body half top side;

a second cut-out located in mirror opposition to said first cut-out along an interior side edge of said second body half rear side, subjacent said second body half top side;

a first handle disposed within said first body half top side;

a second handle disposed within said second body half top side;

an anchor including a rod secured at a proximal end to a central underside portion of said center panel and a plate secured to a distal end of said rod;

wherein said anchor securing said security box to a surface;

wherein said first body half and said second body half are both capable of being in a single closed state;

wherein said first cut-out and said second cut-out are co-aligned with each other when said security box is in said closed state;

wherein said first cut-out and said second cut-out permit a passage of a garden hose and a faucet therethrough;

wherein said a first cut-out includes a first gasket and said second cut-out includes a second gasket;

wherein said first and second gaskets include opposing hemispherical cut-outs;

wherein said first and second gaskets include durable weather resistant rubber; and wherein a first fastener secured along a first interior edge of said first body half front side and a second fastener secured along a first interior edge of said second body half front side opposite said first fastener, are mating with each other to secure said security box in said closed state;

wherein said first body half and said second body half are plastic or metal; and wherein said anchor is metal or plastic.

* * * * *